US010581206B2

(12) United States Patent
Fang et al.

(10) Patent No.: US 10,581,206 B2
(45) Date of Patent: Mar. 3, 2020

(54) CARD EDGE CONNECTOR WITH IMPROVWED GROUNDING BARS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Fang, Huaian (CN); Wen-Jun Tang, Huaian (CN); Xiao-Hu Yin, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/222,507

(22) Filed: Dec. 17, 2018

(65) Prior Publication Data

US 2019/0190212 A1 Jun. 20, 2019

(30) Foreign Application Priority Data

Dec. 15, 2017 (CN) ..... 2017 2 1751739 U
May 17, 2018 (CN) ..... 2018 1 0471219

(51) Int. Cl.
*H01R 13/6597* (2011.01)
*H01R 13/646* (2011.01)
(Continued)

(52) U.S. Cl.
CPC ..... *H01R 13/6597* (2013.01); *H01R 12/737* (2013.01); *H01R 13/50* (2013.01); *H01R 13/646* (2013.01); *H01R 13/6594* (2013.01)

(58) Field of Classification Search
CPC .. H01R 13/6597; H01R 13/646; H01R 13/50; H01R 13/6594; H01R 28/6873; H01R 33/7628; H01R 12/737
(Continued)

(56) References Cited

U.S. PATENT DOCUMENTS 7,578,701 B2 * 8/2009 Hsu ..... H01R 13/6594 439/607.34
9,300,064 B2 * 3/2016 Takenaga ..... H01R 12/716
(Continued)

FOREIGN PATENT DOCUMENTS

CN 201160168 Y 12/2008
CN 102456990 A 5/2012
(Continued)

*Primary Examiner* — Gary F Paumen
(74) *Attorney, Agent, or Firm* — Wei Te Chung; Ming Chieh Chang

(57) ABSTRACT

A card edge connector includes an insulating housing defining a mating slot, two rows of terminals and a grounding member. Each row of terminals includes grounding terminals and signal terminals. The grounding member includes a first grounding bar and a second grounding bar each defining an upper edge and a lower edge. A plurality of elastic tabs extends from the upper edge and contacting with corresponding grounding terminals. The first and second grounding sides are disposed vertically in a bottom and at an outer side of corresponding row of terminals, and extends along the longitudinal direction of the housing under a condition that the upper edges of the grounding sides are disposed below the inner bottom face of the mating slot. The upper edges are located below the inner bottom face of the mating slot.

19 Claims, 16 Drawing Sheets

(51) Int. Cl.
*H01R 13/50* (2006.01)
*H01R 12/73* (2011.01)
*H01R 13/6594* (2011.01)

(58) Field of Classification Search
USPC ..... 439/607.34, 108
See application file for complete search history.

(56) References Cited

U.S. PATENT DOCUMENTS

| | | | | |
|---|---|---|---|---|
| 2005/0282437 | A1* | 12/2005 | Fan | H01R 13/4538 439/607.05 |
| 2007/0199096 | A1* | 8/2007 | Meyer | C12N 9/1007 800/278 |
| 2013/0065439 | A1* | 3/2013 | Yang | H01R 12/724 439/607.34 |
| 2017/0033508 | A1* | 2/2017 | Hsu | H01R 13/405 |
| 2019/0058293 | A1* | 2/2019 | Zhu | H01R 13/6597 |

FOREIGN PATENT DOCUMENTS

| | | | |
|---|---|---|---|
| CN | 202997165 | U | 6/2013 |
| CN | 106356676 | A | 1/2017 |
| CN | 206490257 | U | 9/2017 |

* cited by examiner

CARD EDGE CONNECTOR WITH IMPROVWED GROUNDING BARS

BACKGROUND OF THE DISCLOSURE

1. Field of the Disclosure

The present disclosure relates to a card edge connector, and more particularly to a card edge connector with improved grounding bars.

2. Description of Related Arts

China Utility patent Issued No. CN201160168Y discloses an electrical connector which includes an insulating housing, terminals and a pair of shielding shells covering the outer faces of two long walls of the housing. Each terminal includes a contacting portion, a retaining portion and a leg portion. The terminals are retained and received in the grooves defined in the two long walls. Each shielding shell defines fingers across slots defined on the long wall and contacting with corresponding grounding terminals of the terminals. The fingers bend and press against the grounding terminals at a front distal end thereof. The engagement between fingers and grounding terminals may bring a relative stiff friction and damage the engagement.

China Invention patent Publication No. CN106356676A discloses an electrical connector which includes a terminal module and an insulating housing, the terminal module with a ground bar pre-attached is inserted in the insulating housing. The assembling process of connector is complexity.

An improved card edge connector is desired.

SUMMARY OF THE DISCLOSURE

Accordingly, an object of the present disclosure is to provide a card edge connector, the card edge connector comprises a longitudinal insulating housing comprising opposite first wall and second wall, and a bottom connecting with the first and the second walls, thereby commonly defining a mating slot for receiving an electric card. A plurality of terminals are arranged in two rows, and retained in the first wall and the second wall respectively, the terminals comprise retaining portions retained the first and second walls, elastic mating portions extending in the mating slot and leg portions through a bottom face of the insulating housing. Each row of terminals comprises grounding terminals and signal terminals. A grounding member is retained in the insulating housing and comprises a first grounding side and a second grounding side, each of the first and second grounding side defines an upper edge and a lower edge thereof. A plurality of elastic tabs extends from said upper edge and contacting with corresponding grounding terminals. The first and second grounding sides are disposed vertically in the bottom and at an outer side of corresponding row of terminals, and extends along the longitudinal direction of the insulating housing under a condition that the upper edges of the grounding sides are disposed below the inner bottom face of the mating slot.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

Figure 1:
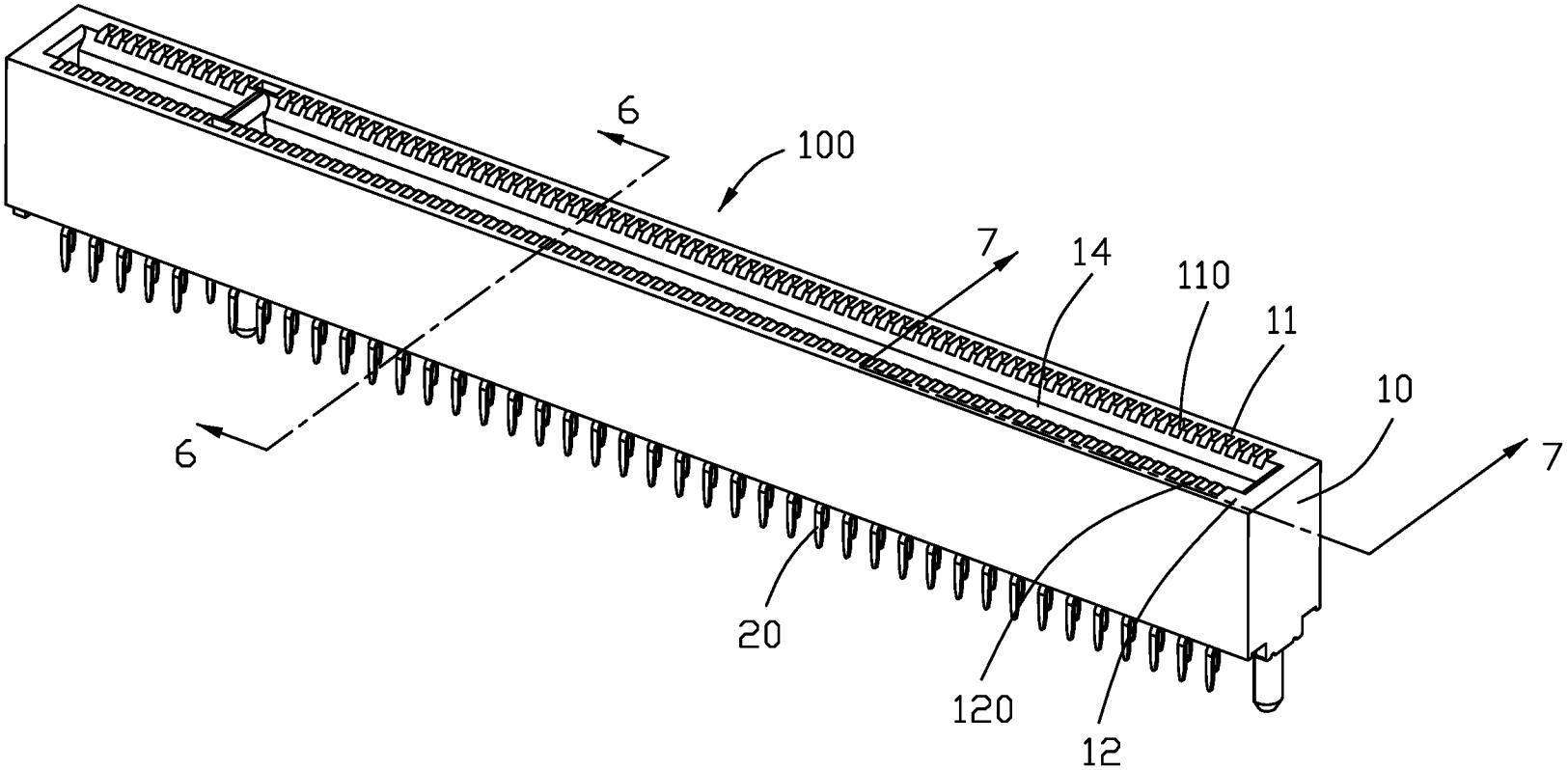
FIG. 1 is a top perspective view of a card edge connector according to one embodiment of the invention.
Figure 2:
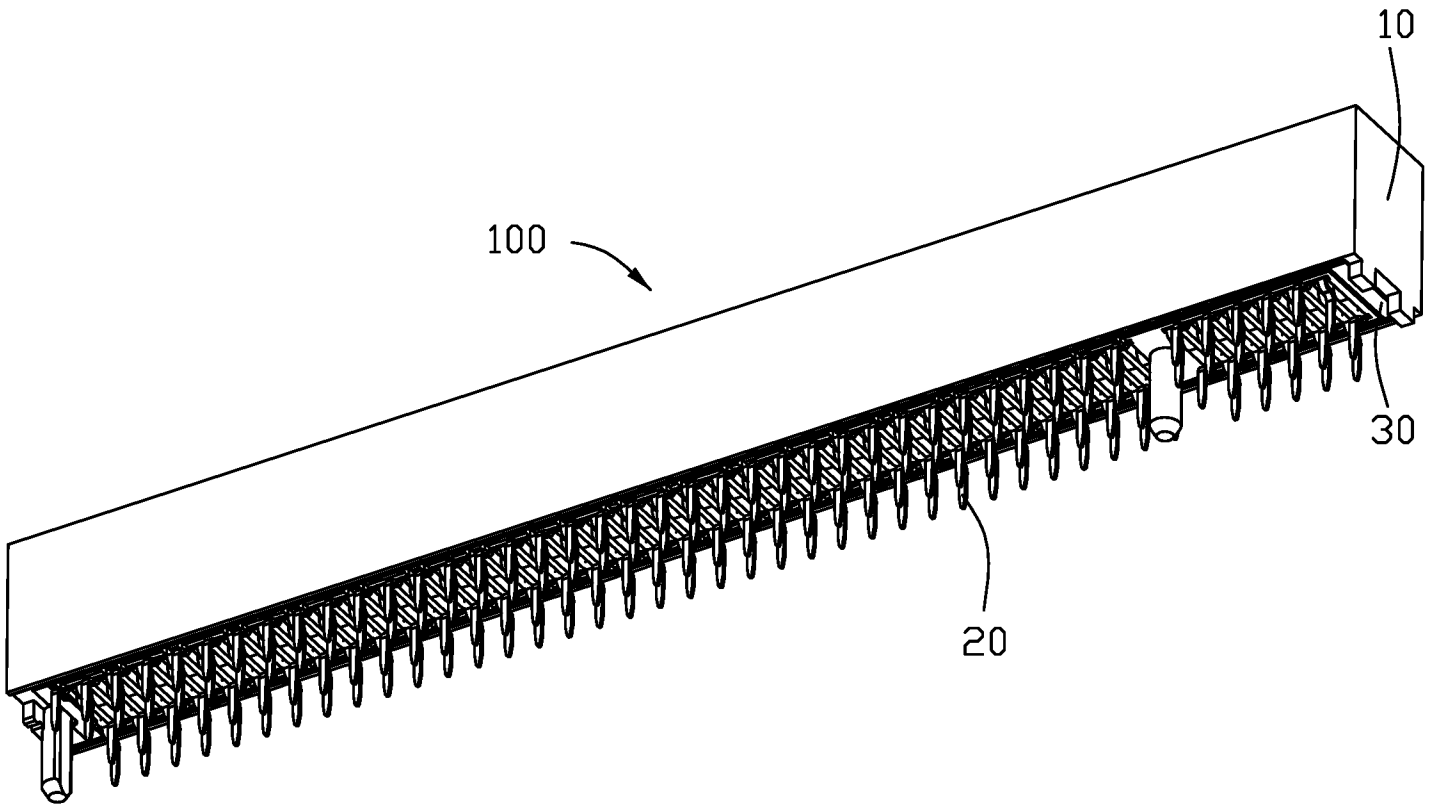
FIG. 2 is a bottom perspective view of the card edge connector of FIG. 1.
Figure 3:
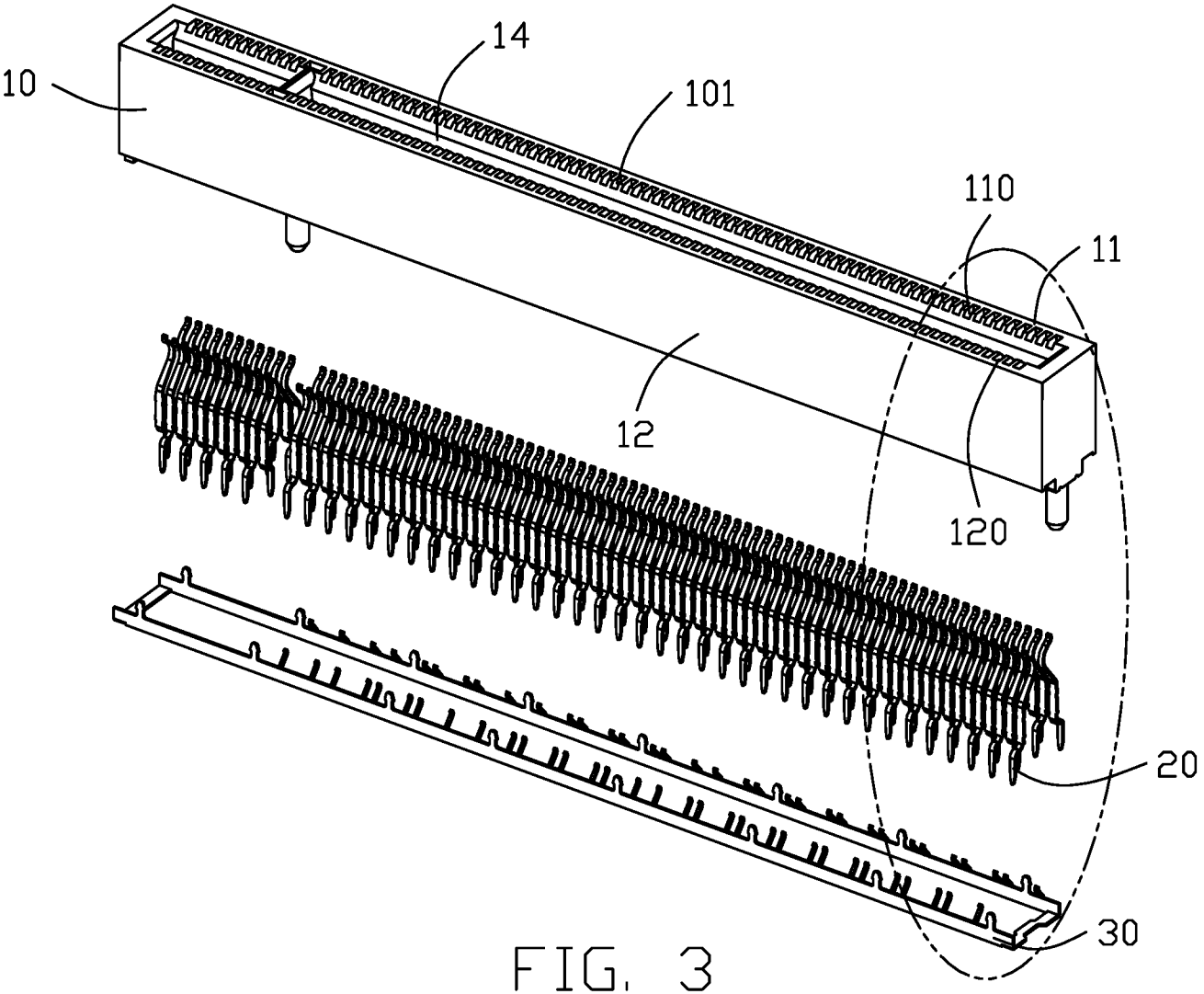
FIG. 3 is a top exploded view of the electrical connector of FIG. 2.
Figure 4:
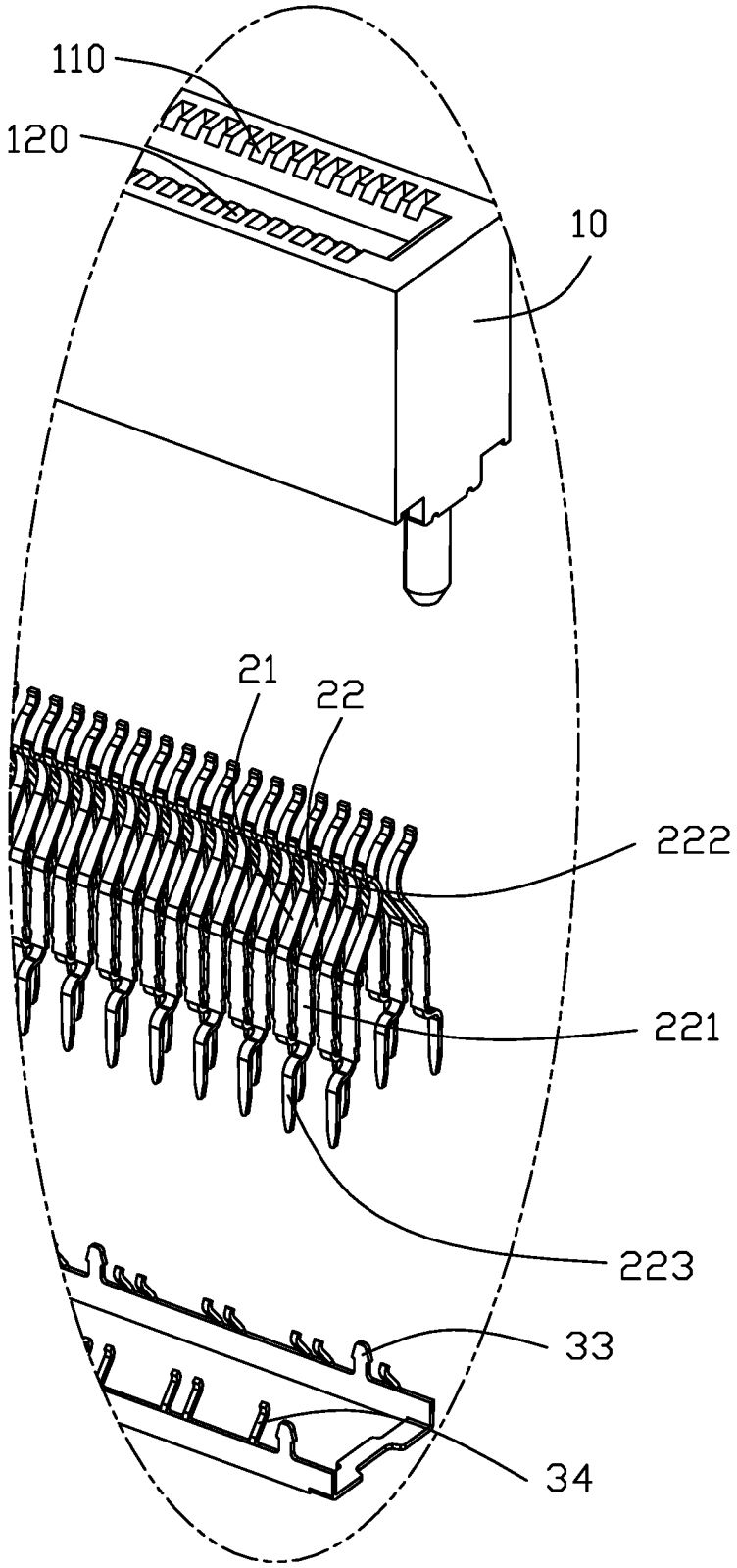
FIG. 4 is an enlarged exploded view of part of the electrical connector circled in FIG. 3.
Figure 5:
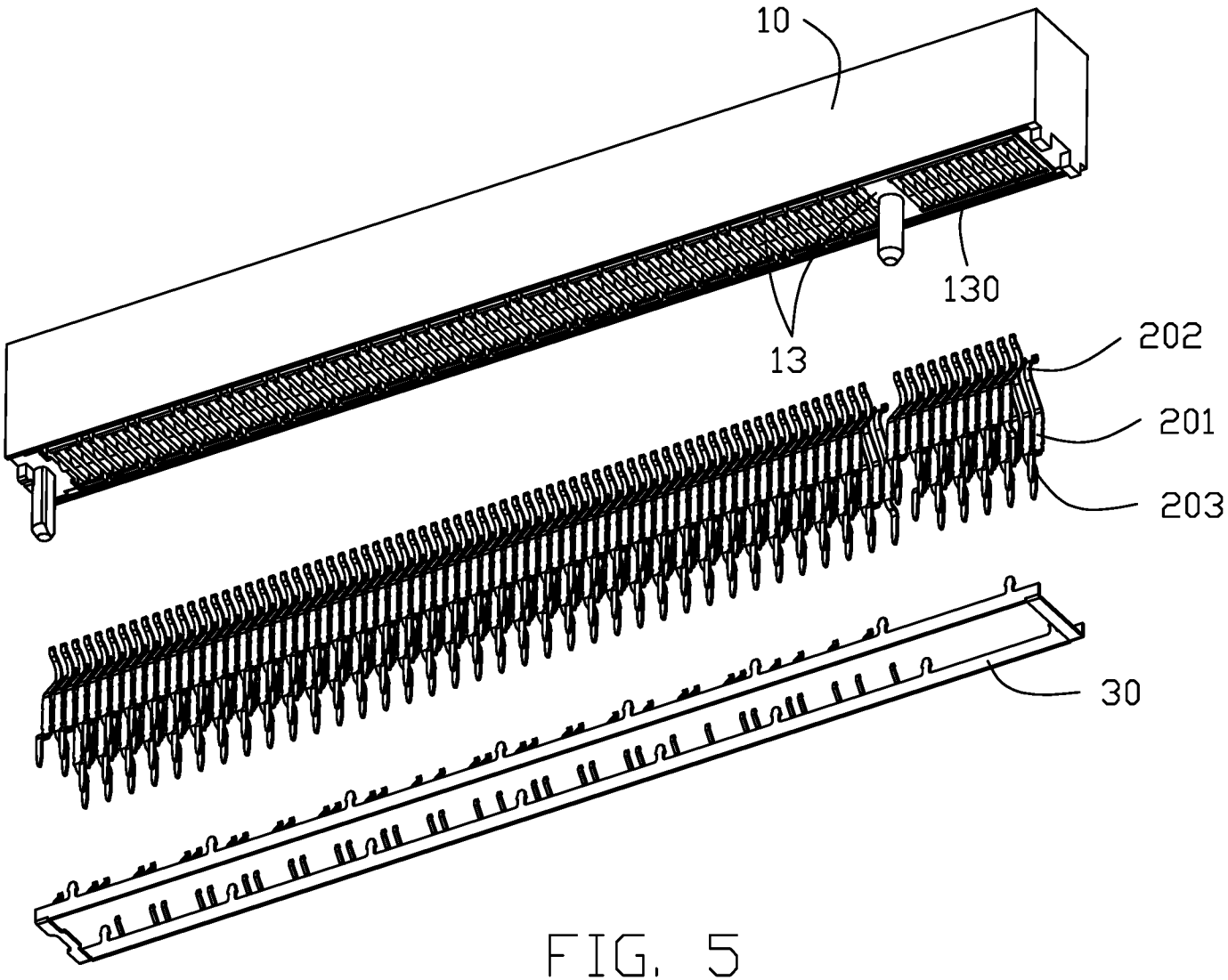
FIG. 5 is a bottom exploded view of the electrical connector of FIG. 3.
Figure 6:
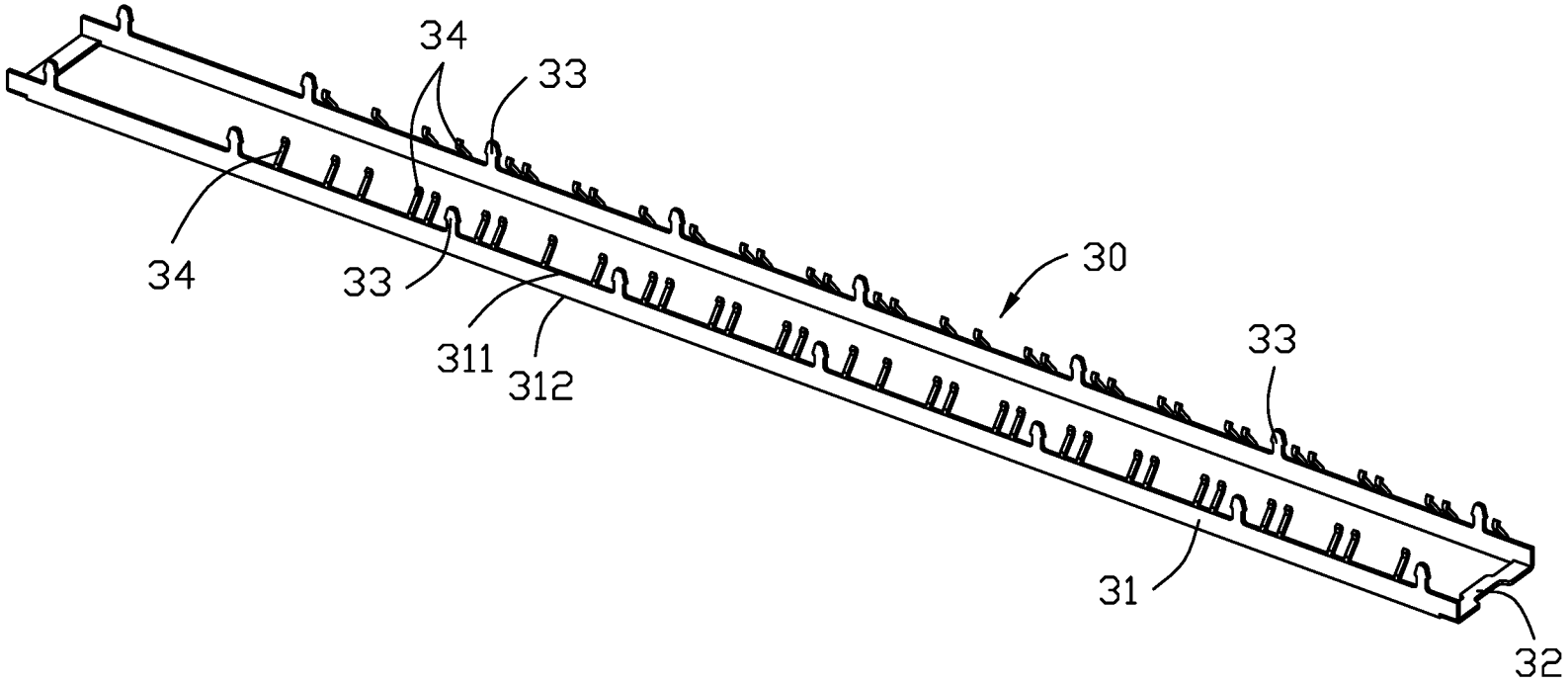
FIG. 6 is a perspective of grounding member.
Figure 7:
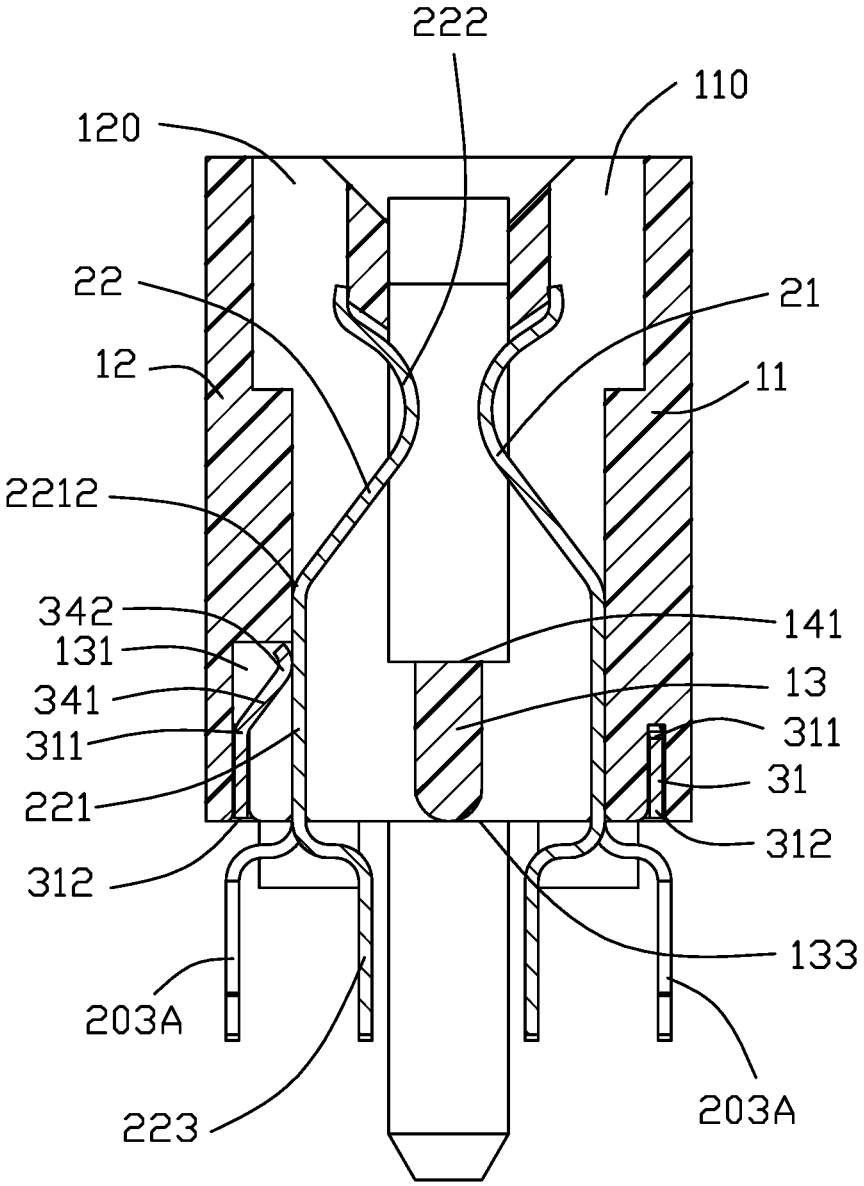
FIG. 7 is a cross sectional view of the electrical connector taken along lines 7-7 in FIG. 1.
Figure 8:
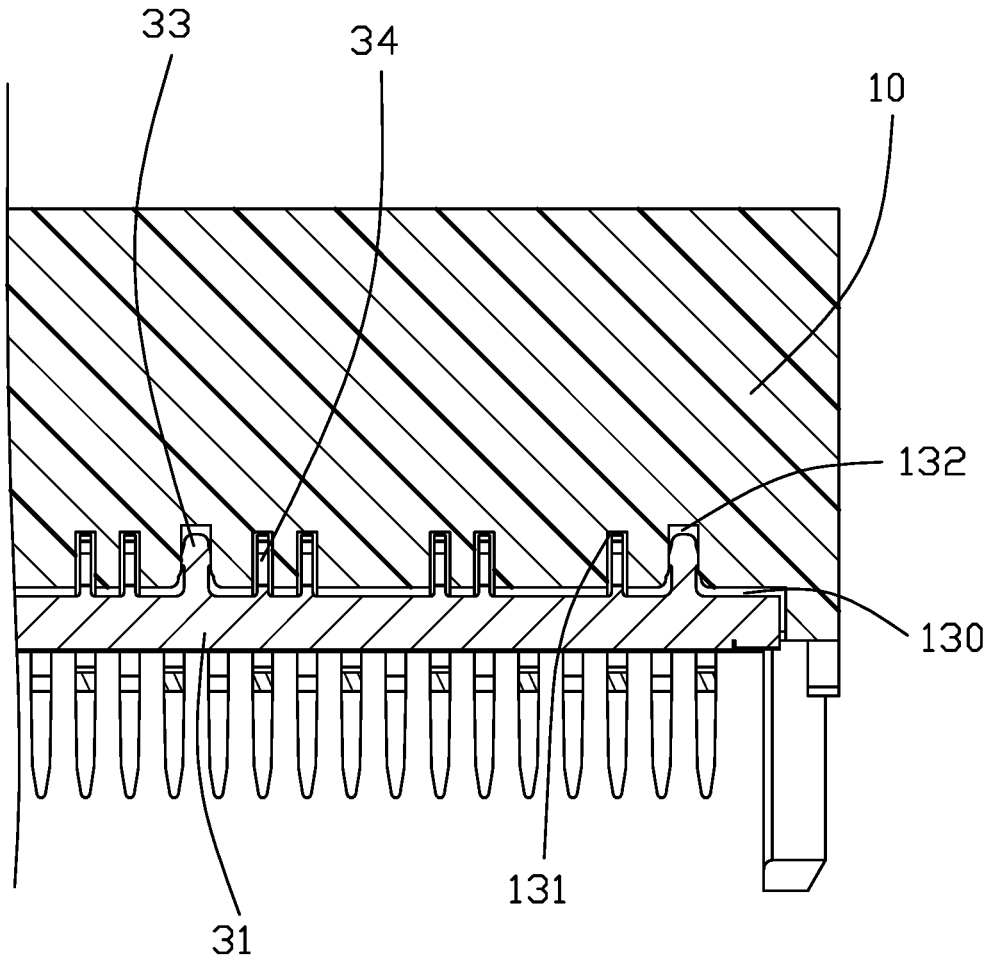
FIG. 8 is a cross sectional view of the electrical connector taken along lines 8-8 in FIG. 1.
Figure 9:
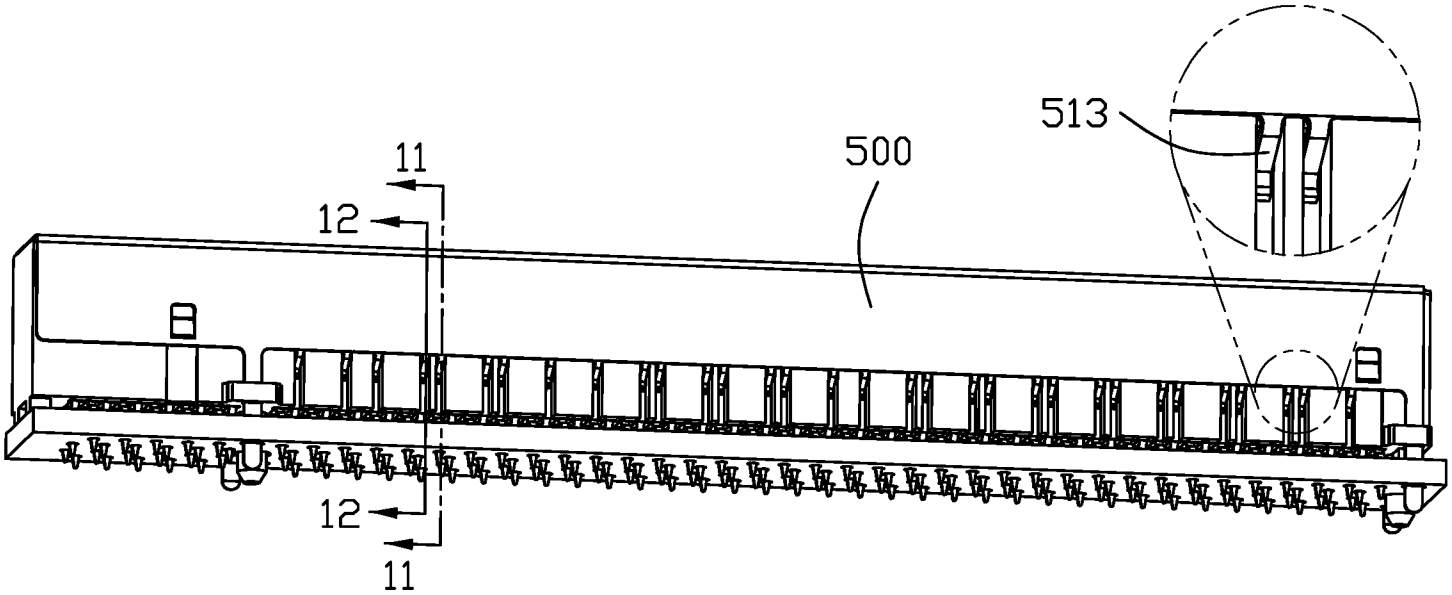
FIG. 9 is a perspective view of a card edge connector of another embodiment of this present invention.
Figure 10:
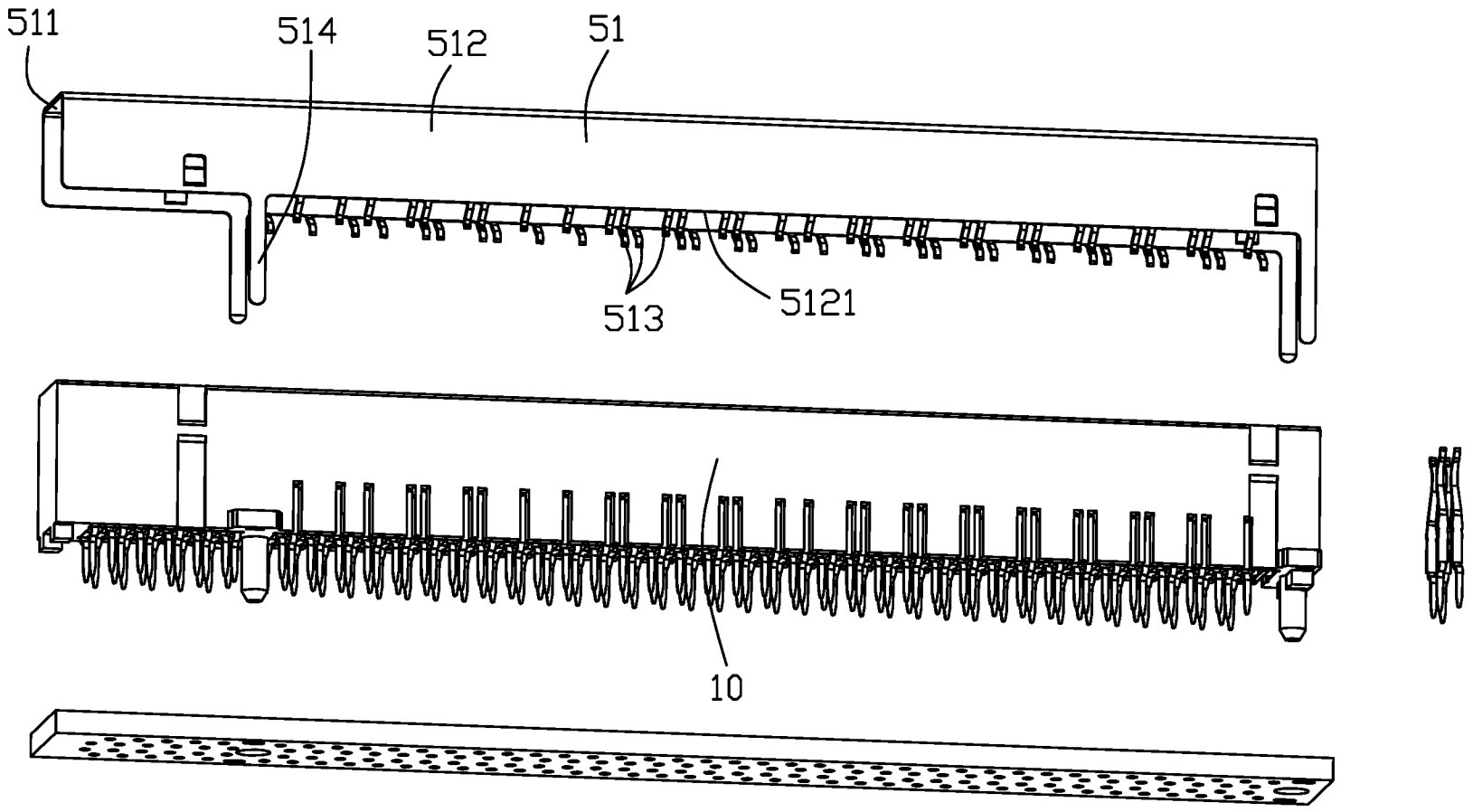
FIG. 10 is an exploded view of the electrical connector of FIG. 9.
Figure 11:
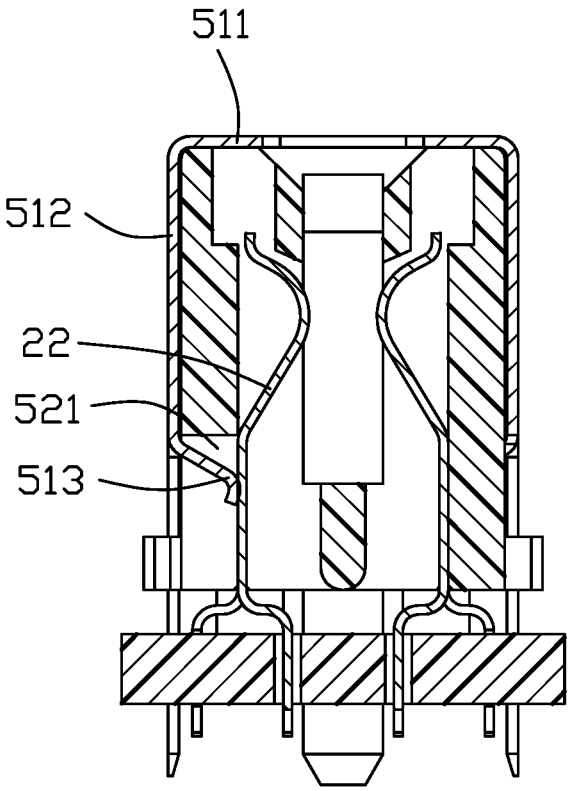
FIG. 11 is a cross-sectional view of the electrical connector of FIG. 9 along line 11-11.
Figure 12:
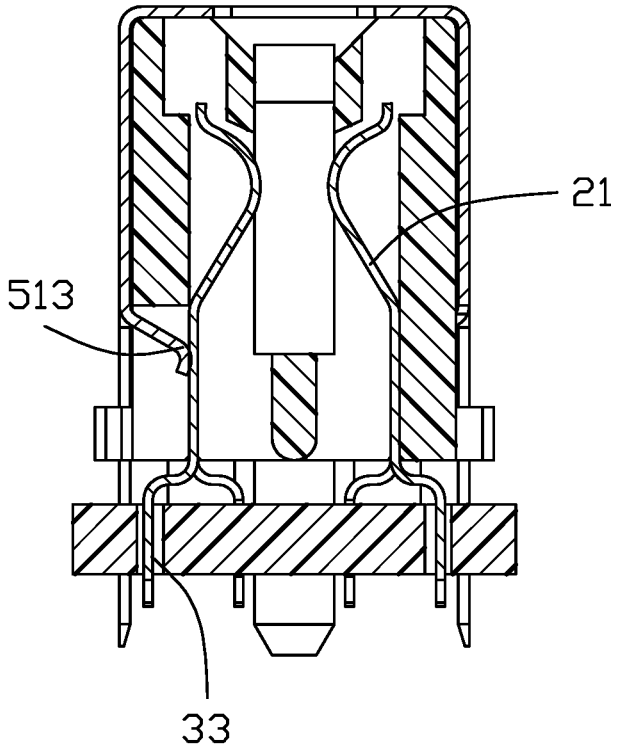
FIG. 12 is a cross-sectional view of the electrical connector of FIG. 9 along line 12-12.
Figure 13:
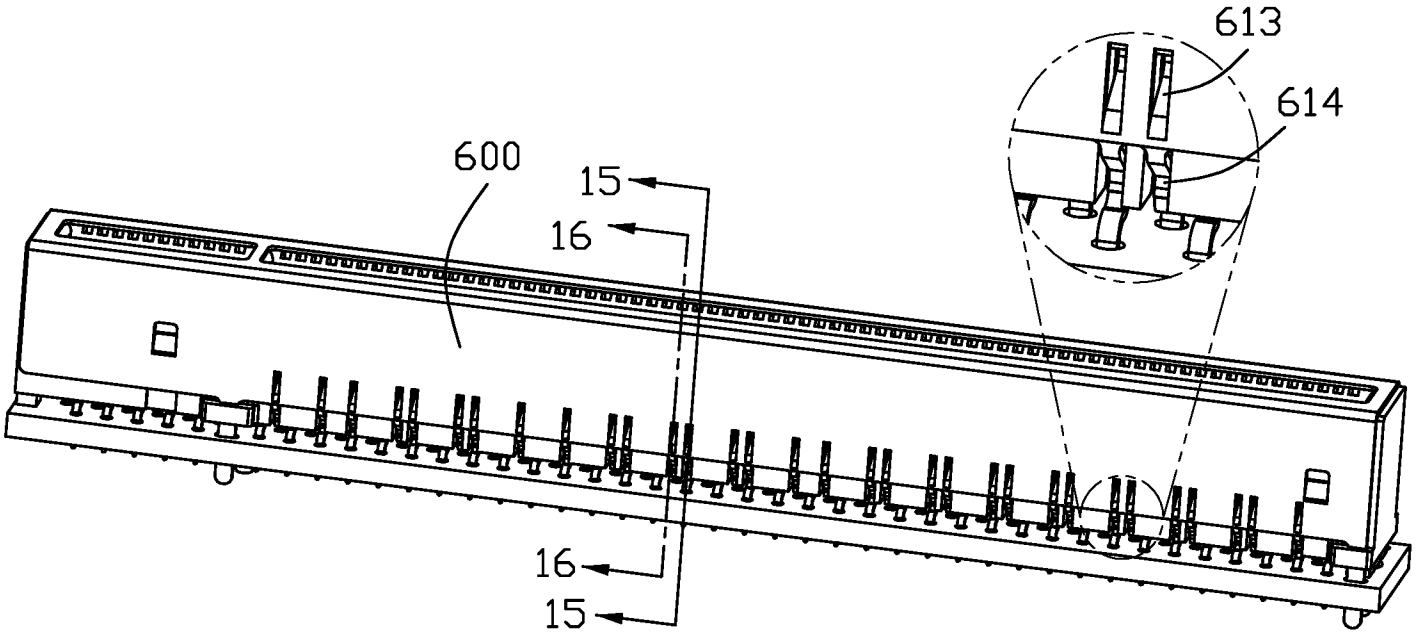
FIG. 13 is a perspective view of a card edge connector of another embodiment of this present invention.
Figure 14:
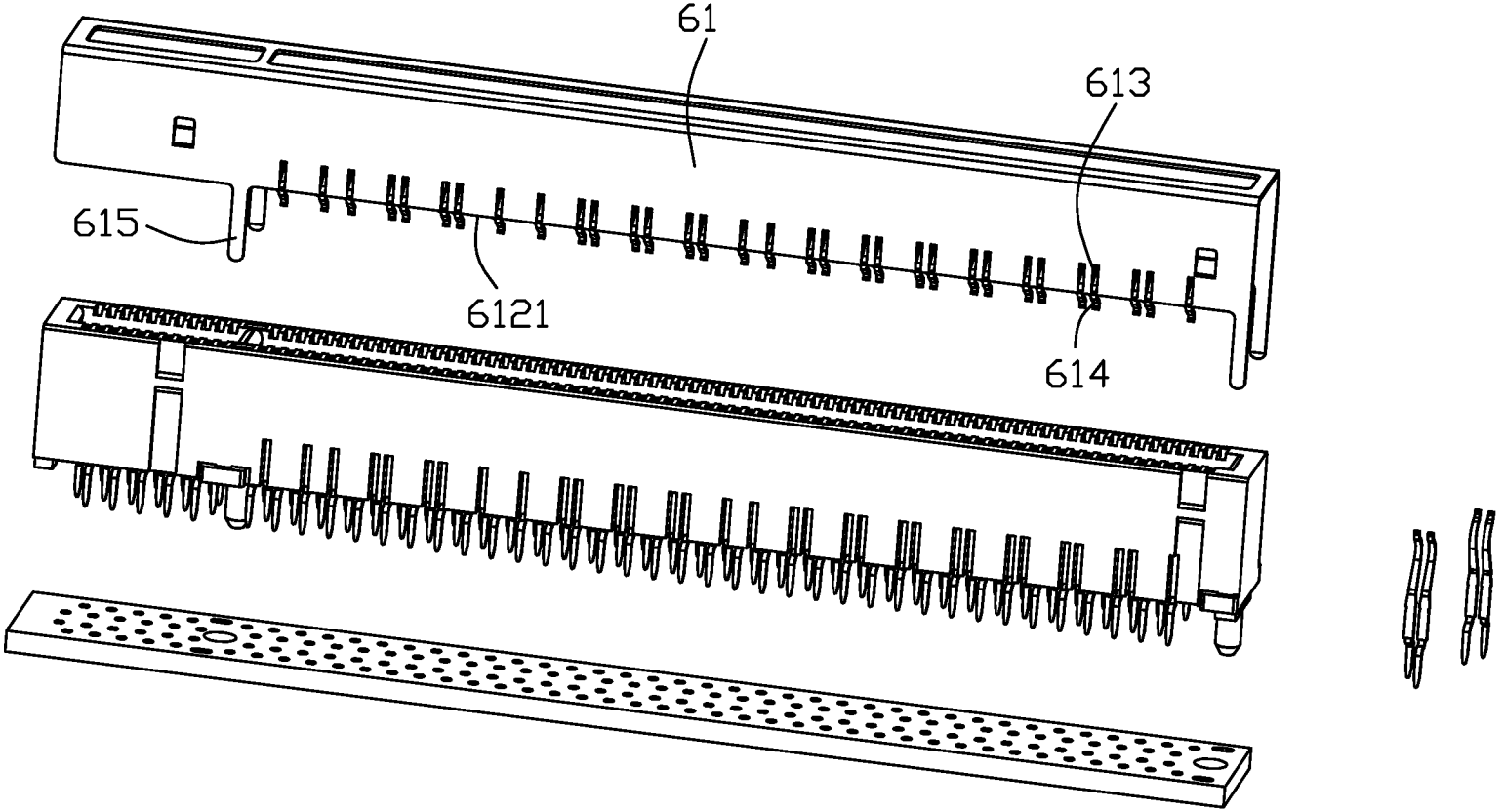
FIG. 14 is an exploded view of the electrical connector of FIG. 13.
Figure 15:
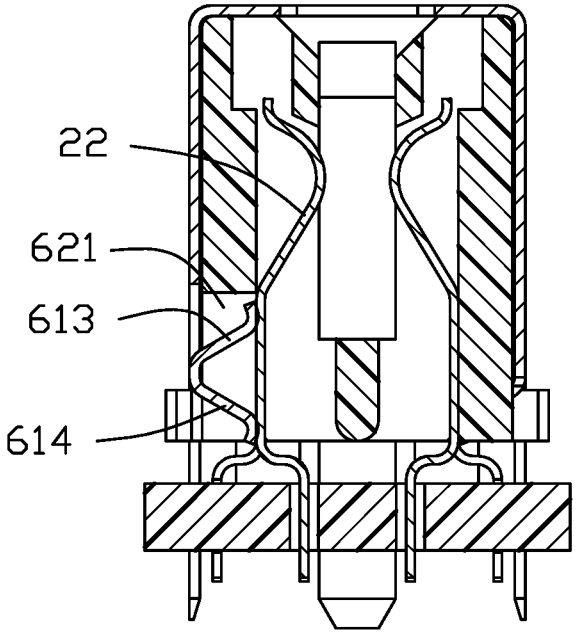
FIG. 15 is a cross-sectional view of the electrical connector of FIG. 13 along line 15-15.
Figure 16:
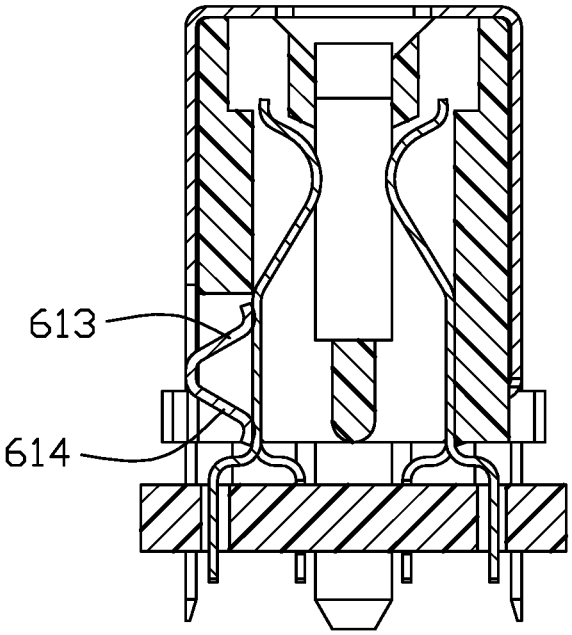
FIG. 16 is a cross-sectional view of the electrical connector of FIG. 13 along line 16-16.

Referring to FIGS. 1 to 5, a card edge connector 100 of one embodiment of the present invention is illustrated, which includes a longitudinal insulating housing 10, a plurality of terminals 20 and a grounding member 30 retained in the housing 10. The insulating housing 10 is recessed with a card slot 14 from a top mating face 101 and includes opposite first wall 11 and second wall 12 and a bottom 13 between the first and second walls 11, 12. The first and second walls extend in the longitudinal direction, i.e., the first and second walls are two opposite long walls which connect with two opposite short walls 15 and the bottom 13. Please notes, the long walls, short walls and the bottom share some common part of the housing 10. The mating slot 14 is defined among the long walls 11, 12, the short walls 15 and the bottom 13, which opens upwards to receive a mating end of electric card. Referring to FIG. 7, the mating slot 14 defines an inner bottom face 141 opening upwards and the housing 10 defines a bottom face 133, the inner bottom face 141 and the bottom face 133 are located at opposite upper and lower faces of the bottom 13. The terminals 20 are set in two rows and arranged in the long walls, i.e. the first wall 11 with a plurality of first grooves 110 and the second wall 12 with second grooves 120 to receive the two rows of terminals 20, respectively.

Referring to FIGS. 4 through 8, each row of terminals 20 includes signal terminals 21 and grounding terminals 22. One row of terminals 20 including the signal terminals 21 and grounding terminals 22 are received in the first grooves 110 defined on the first wall 11, and the other row of terminals 20 including the signal terminals 21 and grounding terminals 22 are received the second grooves 120 defined on the second wall 12. Each terminal 20 includes a vertical retaining portion 201, an elastic mating portion 202 extending upwards from an upper end of the retaining portion 201 and a leg portion 203 extending downwards from a lower end of the retaining portions 201 as best shown 5.

The grounding member 30 is assembled in the bottom 13. The grounding member 30 defines a plurality of elastic tabs 34 contacting with corresponding grounding terminals 22. The grounding member 30 includes two long sides (or long grounding bar) 31, i.e., a first long side and a second long side, and two short sides (or bars) 32 connecting with opposite ends of the long sides 31. Said elastic tabs 34 extend from each long side 31 and touch the grounding terminals 22 on the first wall 11 and the second wall 12. Each long side or grounding bar defines an upper edge 311 and a lower edge 312.

The signal terminals 21 and the grounding terminals 22 are same in structure, the grounding terminal 22 includes a vertical retaining portion 221, an elastic mating portion 222 extending upwards from an upper end 2212 of the retaining portion 221 and a leg portion 223 extending downwards from a lower end of the retaining portions 221. The elastic tabs 34 contact the retaining portion 221 of the grounding terminals 22. The elastic tabs 34 includes a slant portion 341 extending from an upper edge 311 of the long side 31 and an arc contacting portion 342 at an upper distal end of the slanting portion 341, the contacting portion 342 contact the retaining portion 221. The long side 31 further defines retaining tabs 33 interfering with the insulating housing 10 so as to retain the grounding member 30 in the housing. Please notes that the retaining tabs 33 and elastic tabs 34 on the same long bar are arranged alternatively. The long sides 31 are in a vertical form and located at an outer side of the corresponding row of terminals 20. The insulating housing 10 defines two retaining slits 130 extending in the longitudinal direction and opening through the bottom face 133 of the housing, the long sides 31 are inserted in the retaining slits 130 and retained in the retaining slit 130. A plurality of receiving slits or slots 131 is formed to communicate with the retaining slit 130, the elastic tabs cross the receiving slits 131 to contact the grounding terminals. A plurality of retaining slit 132 is formed to receive the retaining tabs 34. The short sides 32 are in a horizontal form and cover bottom face 138 of the housing. The two long sides 31 are inserted in the retaining slit 130 from the bottom face 133 and then the two rows of terminals 20 are inserted in the grooves 110, 120 from the bottom face 138. The leg portions 203 of the same row of terminals 20 are arranged offset to two rows, as best show in FIG. 7, from a bottom view, the two long sides 31 are located overlap with or at an inner side of the corresponding outermost rows 203A of the leg portion 203. Combination with FIG. 7, the upper ends 2212 of the retaining portion 221 is disposed above the inner bottom face 141 of the mating slot 14 while the upper edge 311 of the long sides 31 are below the inner bottom face 141, the contacting portion 342 and the inner bottom face 141 are substantially at a same level. The upper edges 311 of the long sides 31 and the bottom face 133 are substantially at a same level.

Due to grounding long side or grounding bars 31 contacting with the grounding terminals 22, the transmitting speed of the card edge connector 100 is up to 16 GPS, to meet transmitting performance of the PCI-e 4.0 specification. The long bars/sides are short in a height direction of the housing 10 so as to reduce an entire dimension of the connector 100. The insertion of long bars/sides from a bottom face 133 with small height reduces slits or openings which benefits enhancement of strength of the connector. In addition, the grounding bar is essentially hidden from the exterior for superior protection.

Referring to FIGS. 9-12 show a card edge connector 500 of another embodiment, in which the insulating housing and the terminals are similar to the connector 100 shown in FIGS. 1-8 so the similar structure will not described again. The main different part in this embodiment is a grounding member 51. The grounding member 51 includes top wall 511, two long walls 512 bending from the top wall 511 and covering the long walls of the housing 10. A Plurality of elastic tab 513 extend downwards and inwards from a lower edge 5121 of each long wall 512 and cross receiving slots 521 defined in the long walls to contact with the grounding terminals 22. Each long wall further defines a leg 514 extending downwards from the lower edge thereof to mount on the printed circuit board. In this embodiment, the grounding bar further functions as the shielding shell essentially enclosing the housing, thus simplifying the structure arrangement as shown in the third embodiment of the instant invention described later.

Referring to FIGS. 13-16 show a third card edge connector 600 of another embodiment, in which the insulating housing and the terminals are similar to the connector 100 shown in FIGS. 1-8. The grounding member 61 is similar with the grounding member 51 shown in FIGS. 9-12. The main different part is the elastic tabs 613, 614 of the grounding member 61. A Plurality of upper elastic tabs 613 extend upwards and inwards from and a plurality of lower elastic tabs 614 extend downwards and inwards from a lower edge 6121 of each long side, which cross receiving slots 621 defined in the long walls to contact with the grounding terminals at two points. Each long wall further defines a leg 615 extending downwards from the lower edge thereof to mount on the printed circuit board.

Notably, in the invention, in a cross-sectional view only the terminal on one side terminal is the grounding terminal 22 and that on the opposite side is the signal terminal 21, so that the housing 10 optionally only needs to form the corresponding slot/slit in one side of the card slot for receiving the corresponding elastic tab of the grounding bar. Under such a situation, the housing may not suffer the weakness in such a cross-section, compared with the symmetrical arrangement having two elastic tabs on both sides of the card slot in a same cross-section.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. A card edge connector comprising:

a longitudinal insulating housing comprising a first wall and an opposite second wall, and a bottom connecting with the first and the second walls, thereby commonly defining a mating slot for receiving an electric card;

a plurality of terminals arranged in two rows, and retained in the first wall and the second wall respectively, the terminals comprising retaining portions retained in the first and second walls, elastic mating portions extending in the mating slot and leg portions through a bottom face of the insulating housing;

each row of said terminals comprising grounding terminals and signal terminals;

a grounding member retained in the insulating housing and comprising a first grounding side and a second grounding side respectively associated with the corresponding first and second walls, each of the first and second grounding sides defining an upper edge and a lower edge thereof, a plurality of elastic tabs extending from said upper edge and contacting with the corresponding grounding terminals;

wherein the first and second grounding sides are disposed vertically in the bottom of the housing and at an outer side of the corresponding row of terminals, and extends along a longitudinal direction of the insulating housing under a situation that the upper edges of the first and second grounding sides are disposed below an inner bottom face of the mating slot;

wherein the insulating housing defines two retaining slits running through the bottom face thereof, and the first and second grounding sides are inserted in the corresponding retaining slits from the bottom face, respectively.

2. The card edge connector as claimed in claim 1, wherein the elastic tabs elastically press against the retaining portions of corresponding grounding terminals.

3. The card edge connector as claimed in claim 1, wherein each of the first wall and the second wall forms a plurality of receiving slits in which said elastic tabs extend to contact the corresponding grounding terminals, and in a cross-section taken along in a transverse direction, only one of first wall and the second wall forms the receiving slit to receive the corresponding elastic tab therein.

4. The card edge connector as claimed in claim 1, wherein the first and second grounding sides are unitarily connected with two short sides at opposite longitudinal ends thereof.

5. The card edge connector as claimed in claim 4, wherein the two short sides cover the bottom face of the insulating housing.

6. The card edge connector as claimed in claim 1, wherein each of the first and second long sides defines retaining tabs extending upright and interfering in the insulating housing.

7. The card edge connector as claimed in claim 1, wherein the card edge connector transmits speed up to 16 Gbps.

8. The card edge connector as claimed in claim 1, wherein the elastic tabs press against the retaining portions of corresponding grounding terminals.

9. A card edge connector comprising:

a longitudinal insulating housing defining a mating slot opening upward and comprising two opposite long walls and a bottom commonly defining the mating slot, the mating slot defining an inner bottom face, each long wall defining a plurality of grooves through a bottom face of the insulating housing;

two rows of terminals received and retained in the grooves in the long walls, respectively, each terminal comprising a retaining portion retained in the long wall, an elastic mating portion extending in the mating slot and a leg portion through the bottom face, each row of terminals comprising grounding terminals;

a pair of long grounding bars, each defining an upper edge and a lower edge thereof and forming a plurality of elastic tabs, the elastic tabs extending from the upper edge and slanting inward thus contacting with corresponding grounding terminals;

wherein each of the long walls of the insulating housing defines a retaining slit at an outer side of the corresponding grooves, the retaining slits extend in a longitudinal direction of the insulating housing and through the bottom face of the insulating housing, the long grounding bars and the terminals are configured so that the grounding bars are inserted in the retaining slits from the bottom face before the terminals are inserted in the grooves.

10. The card edge connector as claimed in claim 9, wherein the upper edge of each long grounding bar is disposed below the inner bottom face of the mating slot.

11. The card edge connector as claimed in claim 9, wherein each of the elastic tabs includes an inward slanting portion and an arc contacting portion at a distal end of the slanting portion, and the contacting portions press against the retaining portions of corresponding grounding terminals.

12. The card edge connector as claimed in claim 11, wherein the retaining portions of the grounding terminals are disposed vertically and upper edges of the retaining portions are located above the inner bottom face.

13. The card edge connector as claimed in claim 11, wherein the contacting portions of the elastic tabs are located at a substantially same level with the inner bottom face of the mating slot.

14. The card edge connector as claimed in claim 9, wherein the long walls define receiving slits each communicating with the retaining slot and the grooves so that the elastic tabs cross the receiving slits and then contact the retaining portions of the grounding terminals.

15. A card edge connector comprising:

an elongated insulative housing defining a central mating slot extending downwardly from an upper face of the housing in a vertical direction, and further along a longitudinal direction perpendicular to the vertical direction with a pair of side walls by two sides of the mating slot in a transverse direction perpendicular to both the vertical direction and the longitudinal direction, each of said side walls forming a plurality of grooves therein along the longitudinal direction, and receiving slots outside of the corresponding grooves in the transverse direction;

two rows of terminals respectively disposed in the corresponding grooves of the pair of side walls and including grounding terminals and signal terminals, each of said terminals including a mating portion extending into the mating slot, a retaining portion located below the mating portion and securely retained in the corresponding side wall; and a unitary metallic grounding member having a U-shaped cross-section and downwardly in the vertical direction attached upon the housing to cover both the upper face and said side walls while upwardly exposing the central mating slot, and including a plurality of elastic tabs extending into the corresponding receiving slots to contact the corresponding grounding terminals, respectively.

16. The card edge connector as claimed in claim 15, wherein in a cross-section of the housing taken along the transverse direction, only one elastic tab is disposed in one of said pair of side walls.

17. The card edge connector as claimed in claim 15, wherein not all the grooves are equipped with the corresponding receiving slots aside to receive the corresponding elastic tabs.

18. The card edge connector as claimed in claim 15, wherein each of said receiving slots is open outwardly in the transverse direction to receive the corresponding elastic tab therein.

19. The card edge connector as claimed in claim 15, wherein each of said elastic tabs extends in a cantilevered manner with a downwardly extending free end.

* * * * *